US005295679A

United States Patent [19]

Reist

[11] Patent Number: 5,295,679

[45] Date of Patent: Mar. 22, 1994

[54] METHOD AND APPARATUS FOR CONVEYING AWAY FLAT PRODUCTS SUPPLIED IN SCALE FLOW, PARTICULARLY PRINTED PRODUCTS

[75] Inventor: Walter Reist, Hinwil, Switzerland

[73] Assignee: Ferag AG, Hinwil, Switzerland

[21] Appl. No.: 904,703

[22] Filed: Jun. 26, 1992

[30] Foreign Application Priority Data

Jun. 27, 1991 [CH] Switzerland ..... 01904/91-8

[51] Int. Cl.[5] ..... B65H 29/68

[52] U.S. Cl. ..... 271/182; 271/184; 271/186; 271/204

[58] Field of Search ..... 271/69, 182, 183, 184–186, 271/204, 205

[56] References Cited

U.S. PATENT DOCUMENTS

| | | | |
|---|---|---|---|
| 4,201,286 | 5/1980 | Meier | 198/461 |
| 4,320,894 | 3/1982 | Reist et al. | 271/69 X |
| 4,333,559 | 6/1982 | Reist | 271/204 X |
| 4,905,981 | 3/1990 | Reist | 271/233 |

*Primary Examiner*—David H. Bollinger
*Attorney, Agent, or Firm*—Walter C. Farley

[57] ABSTRACT

A method for transforming a scale flow of printed products into a delivery flow of printed products in forced formation, typically a delivery flow in which each printed product is guided by a gripper, essentially comprises four method steps, namely a first deflection or reversal (1) through which a scale flow (B) with downwardly directed leading printed product edges is formed; a timing step (2) in which the spacings between the printed products are made uniform, increased; decreased and/or differentiated, a second deflection or reversal (3) in which a scale flow (D) with upwardly directed leading edges is produced; and an acceptance (4) in which the printed products are individually or groupwise taken over by grippers. The first and/or second deflection or reversal can be omitted. The apparatus for performing the method essentially comprises a supply belt conveyor (5) and a conveying away means (6), between which are arranged a timing element (21) and at least one intermediate belt conveyor. The timing element (21) has a stationary stop element (21.1), which individually or groupwise stops the printed products, and a movable conveyor element (21.2), which raises the printed products in timed individual or groupwise manner over the stop element (21.1).

18 Claims, 4 Drawing Sheets

METHOD AND APPARATUS FOR CONVEYING AWAY FLAT PRODUCTS SUPPLIED IN SCALE FLOW, PARTICULARLY PRINTED PRODUCTS

FIELD OF THE INVENTION

The present invention is in the field of the further processing of printed products. It relates to a method and an apparatus for conveying away flat products, particularly multishaped, folded printed products, which are supplied in roofing-tile, overlapping, successive manner in a scale flow with a given reciprocal spacing using a conveying means and which in each case secures a printed product or a group of printed products.

BACKGROUND OF THE INVENTION

Printed products are typically spread out by rotary machines or from corresponding buffer or intermediate stores, such as in rolls, in scale flow form. For subsequent processing and conveying stages it is advantageous to convey on such scale flows in some other form, e.g. as a feed or delivery flow, in which each printed product or a given number of printed products is conveyed by a gripper with a pulling member moving a plurality of such grippers. Thus, from a free formation in which the individual products are not kept in a relative position to one another, a forced formation is formed, in which the reciprocal relative position of the printed products is rigidly defined by the gripper or similar conveying tools. For the transformation of the scale flow into a feed flow with grippers the scale flow is guided on a supply belt conveyor into a corresponding takeover or acceptance area, in which the printed products are engaged by the grippers.

Apparatus for such an acceptance and conveying away are known, e.g. from Swiss patent 630583, to which the U.S. counterpart is 4,320,894, and European patent 330868, to which the U.S. counterpart is 4,953,847. These specifications describe methods and apparatuses with which a scale flow, such as is e.g. spread out by a rotary machine, is converted into a feed flow with grippers moved on a pulling member, whereof each conveys one or more products of the scale flow. Conventionally in the supply scale flows the printed products are arranged in such a way that each product is partly covered by the follow-up or following product or products, i.e. the leading edges of the printed products in the delivery direction rest on the top of the scale flow. So as to ensure that during takeover the products do not have to be advanced under one or more following products, the aforementioned methods preferably prescribe, prior to the actual acceptance, a deflection of the scale flow by approximately 180° in the upwards or downwards direction, so that each product of the scale flow rests on the following product or products and consequently the leading edges of the printed products in the delivery direction rest on the contact side (underside) of the scale flow. However, the aforementioned specifications also describe embodiments, which are used for the conveying away of scale flows with the leading edges at the top.

Non-uniformities in the spacings of the printed products of a scale flow can, in the case of the aforementioned apparatus, lead to damage to the printed products, e.g. due to the grippers, so that it is advantageous to render uniform or correct during acceptance or takeover not only the lateral orientation of the printed products, but also their spacings in the conveying direction prior to the actual acceptance. Thus, for example, Swiss patent 630583 describes means with which products delivered with an inadequate spacing are stopped immediately prior to acceptance and are consequently correctly timed, whereas products supplied with too large a spacing are transferred to the next following gripper. This makes it possible to prevent damage and account can be taken of errors in the following delivery flow.

In the case where more than one printed product is engaged and conveyed away by a single gripper, the aforementioned specifications describe two variants. Either the printed products are oriented at a stop (CH 630583), so that their leading edges rest on one another when they are finally taken up by a gripper, or they maintain their reciprocal spacing from the scale flow (EP 330868), so that at any time and without auxiliary means they can be spread out again in the same scale flow.

It has been found that the above-described apparatus are complicated and take up too much space. This more particularly applies if the position of the printed products in the grippers or the relative position of several printed products grasped by a gripper must be accurate within said gripper and if, prior to the actual takeover, it is necessary to provide a separate device for rendering uniform the spacings of the printed products in the scale flow. It would also be desirable if a corresponding apparatus could be easily adapted to different requirements in order to bring about maximum and optimum utilization.

SUMMARY OF THE INVENTION

An object of the present invention is to provide a method for product flow transformation. As a result of the inventive method it is possible to transform a delivery flow of products in free formation, e.g. printed products in scale formation, into a delivery flow of said products in forced formation, e.g. using grippers. Compared with corresponding known methods, the inventive method is more easily adaptable to different applications. It is also the on object of the invention to provide an apparatus for performing the method, which improves known apparatus as regards adaptability, space requirements and degree of complication.

The inventive method is essentially based on the idea that the printed products of the scale flow supplied (free formation), prior to being taken over the grippers (forced formation), are brought into a takeover or acceptance formation. The latter is also a scale flow (free formation), the spacings between the products for acceptance being precisely adjusted in accordance with requirements and, according to requirements the leading edges of the products rest on the lower or upper side of the scale flow. The spacings of the printed products in the acceptance formation can be increased, decreased or merely made uniform compared with the spacings in the original, supplied scale flow, or it is possible to form in the acceptance flow groups, which are then gripped by in each case one gripper and within which the spacings between the products can be reduced to zero compared with the corresponding spacings in the supplied scale flow, whereas the distances between the groups are increased. This means that the acceptance formation can differ from the supply formation by smaller divergences from the desired product spacings, through the position of the leading edges and/or through the timing.

The grippers have no problems in gripping such a scale flow set up for acceptance and the production of the acceptance formation which, unlike in the known methods, does not take place at the acceptance point, can be more easily carried out and adapted.

Another advantage of the inventive method is that in each case it is the same edge of each printed product, which is on the one hand oriented and on the other gripped by the gripper for conveying away.

The inventive method comprises four method steps, namely a first position correction for timing, a timing, a second position correction for acceptance and the effective acceptance. The two position corrections are only necessary if the position of the printed products in the scale flow is not correct for the following method step (timing or acceptance) and normally consists of an approximately 180° upwards or downwards deflection, the scale flow being reversed.

The main feature of the inventive apparatus is that between the supply belt conveyor conveying the scale flow into the vicinity of the inventive apparatus and the conveying away means, which conveys the printed products out of the vicinity of the inventive apparatus, a timing or clock element is provided and in the conveying direction following the latter an intermediate belt conveyor, it being possible to provide a further intermediate belt conveyor in the conveying direction upstream of the timing element.

Between the end of the supply belt conveyor and the acceptance by the gripper of the conveying away means, the acceptance formation is set up by the timing element with respect to the reciprocal relationship of the individual product spacings and by the intermediate belt conveyor or conveyors with respect to the absolute size of the product spacings and the position of the leading edges relative to the scale flow.

The timing element preferably processes a scale flow with the leading edges of the printed products resting on the lower surface, so that as a function of the position of the leading edges in the supplied scale flow, the latter must be deflected upwards or downwards by approximately 180° upstream of the timing element by a first intermediate belt conveyor. It has been shown that the takeover of the printed products from a scale flow with leading edges on the top can save space, so that it is advantageous to deflect upwards or downwards again by 180° the scale flow between the timing element and the acceptance point using a second intermediate belt conveyor.

BRIEF DESCRIPTION OF THE DRAWINGS

The inventive method and apparatus and installations thereof are described in greater detail hereinafter with reference to the following drawings wherein.

DESCRIPTION OF THE PREFERRED EMBODIMENTS

Figure 1:
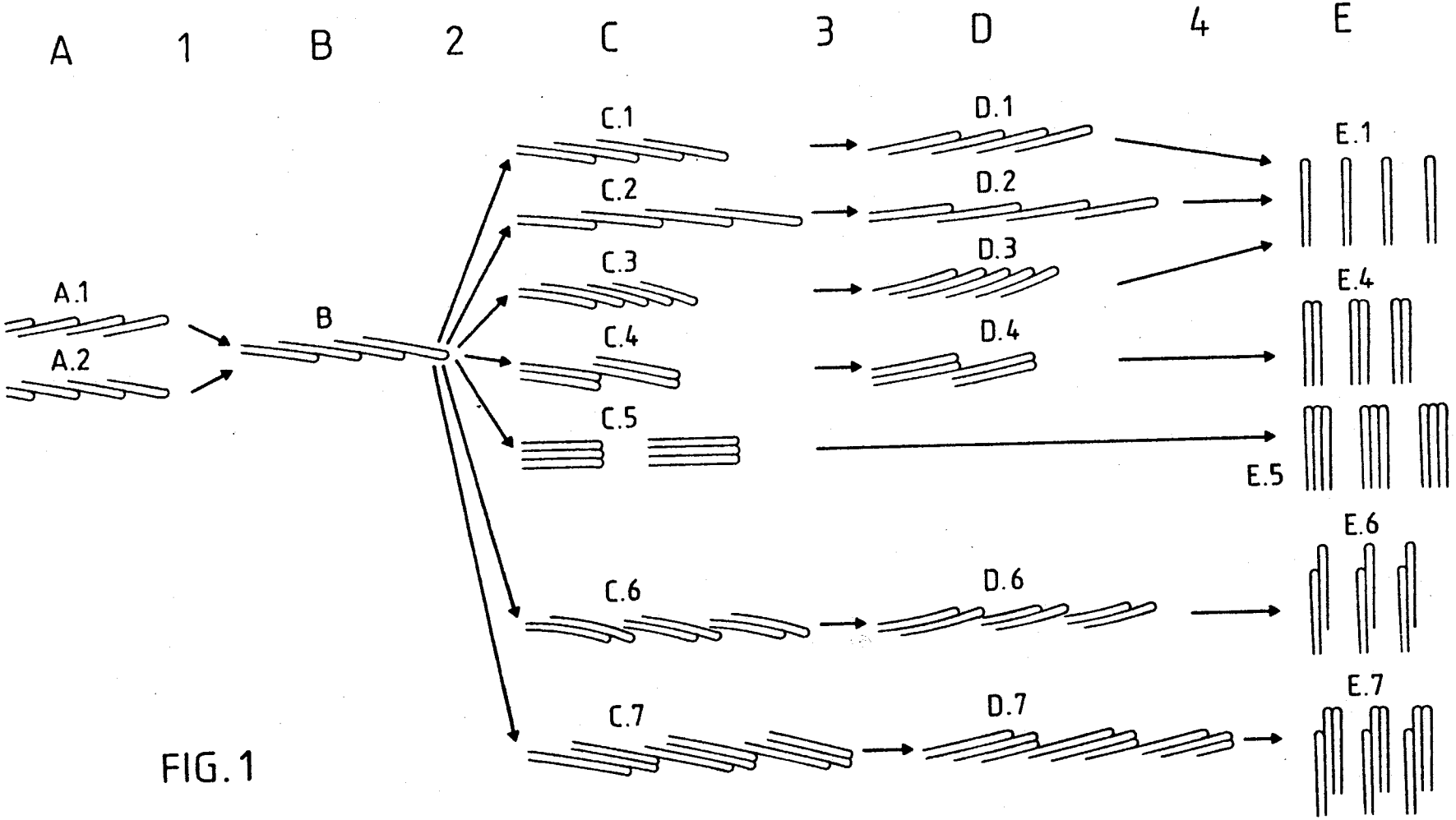
FIG. 1 is a flow diagram illustrating the method of the invention.

FIG. 1 is a diagram of the inventive method, in which the different formations of the printed products between the supply by the supply belt conveyor and the conveying away by the conveying away means are designated A, B, C, D and E, whereas the individual method steps in which the formations are produced are designated 1, 2, 3 and 4. The general conveying direction is from left to right, although in two method steps (cf. following description) the flows are reversed by approximately 180°.

A scale flow A (supply flow), in which the leading edges of the printed product rest on the top of the flow (A.1) or on its bottom (A.2) and have a scale spacing of e.g. 30 to 120 mm, is supplied to the inventive method steps. In a first method step 1 (first deflection), which is only necessary for case A.1, the supply flow is transformed into a scale flow B with the leading edges of the printed products at the bottom and simultaneously the scale spacings can be increased or decreased. The spacings between the printed products of the scale flow B are rendered uniform or differentiated to a flow C in a method step 2 (timing). Thus, they are merely made uniform, which gives the scale flow C.1, increased and made uniform, giving the scale flow C.2 with product spacings of e.g. 50 to 120 mm, or decreased and made uniform, which gives the scale flow C.3. Alternatively the spacings are differentiated, so that groups with super imposed leading edges are formed (groups of two: C.4, groups of three: C.5, etc.), which are conveyed on as a scale flow or in juxtaposed form, or groups with specific spacings between the leading edges of the printed products (groups of two: C.6, groups of three: C.7, etc.), which can also be conveyed on in juxtaposed form or as scale flows. In a third method step 3 (second deflection) which is only necessary if the acceptance for a scale flow D is intended to have the leading edges at the top, the scale flow C is deflected again, which gives a scale flow D, in which the leading edges of the printed products or printed product groups are directed upwards again (D.1 to D.7). In the final method step 4 (acceptance), the printed products are accepted individually or in groups by the grippers of the conveying away means and this leads to the delivery flow E (E.1 to E.7, gripper not shown).

The first deflection or reversal (method step 1) is only necessary if the leading edges of the printed products in the supplied flow A are at the top, whereas it is unnecessary in the present case if the flow has the leading edges at the bottom. It consists of an approximately 180° upwards or downwards scale flow deflection, which normally takes place at a deflection or reversal point of the belt conveyor (first intermediate belt conveyor), while the printed products are pressed by a pressure belt onto the conveyor belt. The pressure belt is positioned in such a way that the scale flow is conveyed between the belt conveyor and the pressure belt, the pressure belt moving at the same speed as the belt conveyor and exerting a contact pressure on the scale flow. With the same speed of the first intermediate belt conveyor and the supply belt conveyor, there is no change to the spacings between the printed products on transfer from the supply belt conveyor to the intermediate belt conveyor, whereas in the case of a higher intermediate belt conveyor speed there is an increase in the spacings and with a lower belt conveyor speed a decrease in the spacings.

The timing (method step 2) is brought about by a clock or timing element, which in the conveying direction is linked to the supply belt conveyor or to the first intermediate belt conveyor. The prior art already discloses timing elements which merely render uniform the spacings of a scale flow. Corresponding elements are described in the present Applicant's European patent 254851 and U.S. Pat. No. 4905981, one timing element interacting with the leading edges of the printed products and the other with their trailing edges. In order to achieve the object of the invention, it is necessary here to have a timing element, which can not only render uniform, but also differentiate a supplied scale flow as a function of the setting. It must not be necessary to replace it for these two different functions and instead the changeover must be possible through corresponding control instructions of a hand setting or from a central, master control system. An embodiment of a suitable timing element is described in conjunction with the following drawings.

The second function of the timing element is the transfer of the printed products to the second intermediate conveyor. If the second intermediate belt conveyor speed is the same as that of the belt conveyor conveying the products to the timing element, then the average spacing between the printed products in the scale flow on the second intermediate belt conveyor will be the same as that upstream of the timing element. If the second intermediate belt conveyor speed is higher there is an increase in the spacing, whereas if it is lower the spacing between the printed products decreases.

In a third method step the scale flow produced by the timing element and speed ratios of the belt conveyors is conveyed to the acceptance point, where it can be deflected or reversed upwards or downwards by approximately 180° if the acceptance requires leading edges of the printed product at the top of the scale flow. For such a deflection the second intermediate belt conveyor is equipped in the same way as the first.

It is advantageous to orient the printed products with respect to the position of their lateral edges before they pass the timing element. This best takes place with corresponding side straighteners in the vicinity of the end of the supply belt conveyor or in the vicinity of the first intermediate belt conveyor.

Figure 2:
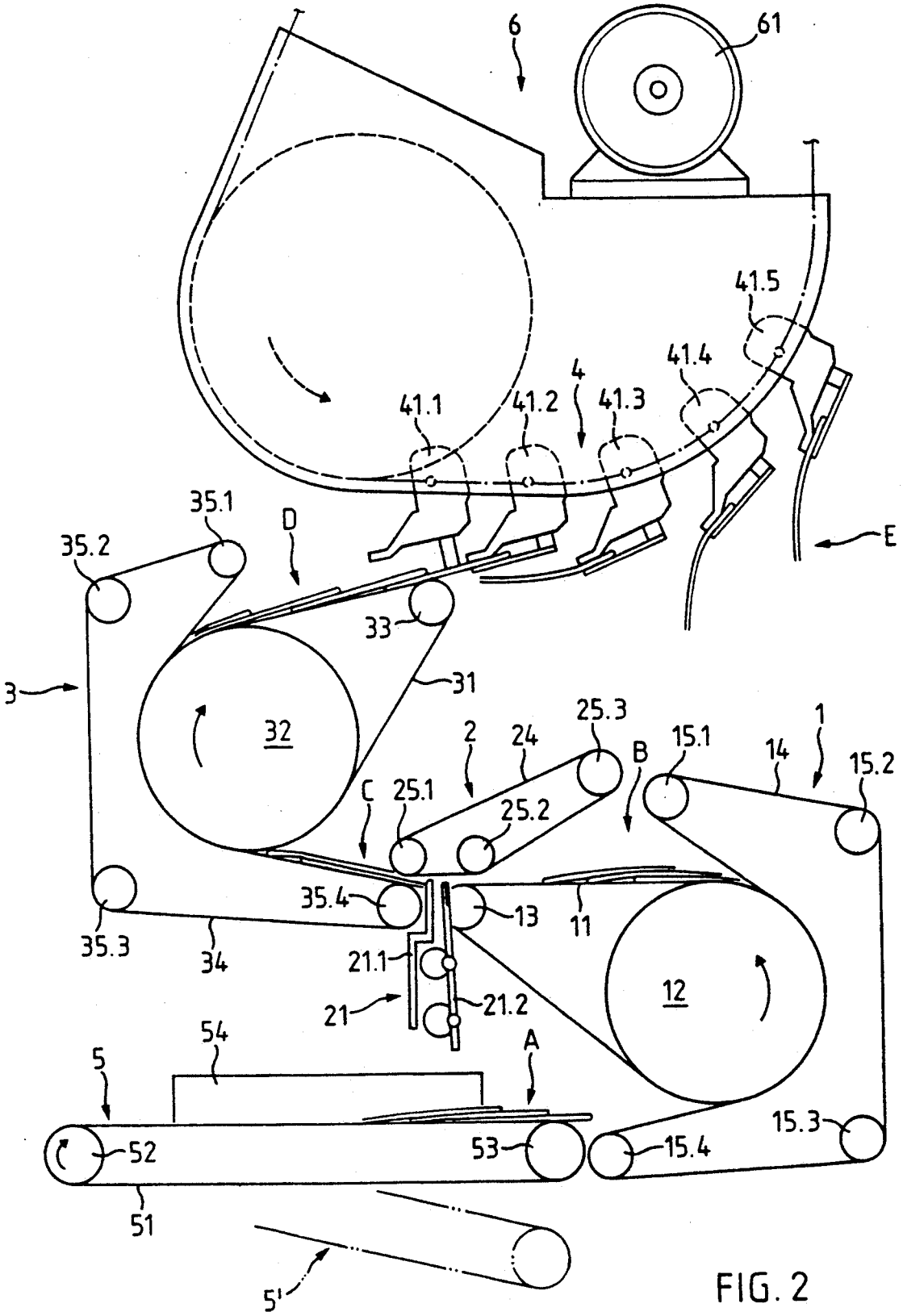
FIG. 2 is a schematic side elevations of an embodiment of an apparatus in accordance with the invention, viewed at right angles to the plane in which material travels.

FIG. 2 diagrammatically shows an embodiment of the inventive apparatus. It is an apparatus for performing the method with first deflection, timing and second deflection. The groups of apparatus parts and formed formations of printed products arranged for the corresponding method steps are given the same reference numerals or letters as in FIG. 1, i.e. supply flow A, first deflection 1 (substantially first intermediate belt conveyor), scale flow with downwardly directed leading edges B, timing 2 (essentially area between first and second intermediate belt conveyors with timing element), rendered uniform or differentiated scale flow with downwardly directed leading edges C, second deflection 3 (substantially second intermediate belt conveyor), acceptance flow D, acceptance 4 (substantially delivery area of the second intermediate belt conveyor and acceptance area of the conveying away means) and delivery flow with grippers E.

The supply flow is supplied on a supply belt conveyor 5 comprising a belt 51, take-up roll 52 and delivery roll 53. The supply belt conveyor can be flanked by side straighteners 54 and can be pivotably constructed in such a way that it can be pivoted into a position 5' if the supplied scale flow for any reason cannot be supplied to the conveying away means.

The first deflection or reversal (method step 1) is brought about by a first intermediate belt conveyor, which has a deflection or reversal belt 11, which runs over at least two rolls, namely a reversal roll 12 and a delivery roll 13, as well as a pressure belt 14, which e.g. runs over four (at least three) rolls 15.1, 15.2, 15.3 and 15.4 the reversal roll 12. Of the four rolls 15.1/2/3/4 of the pressure belt, one (15.4) is located in the vicinity of the delivery roll 53 of the supply belt conveyor and serves as a take-up roll for the intermediate belt conveyor. The arrangement is such that the pressure belt 14 has as a result of the reversal on the reversal roll 12 a configuration projecting as a concave curve into the polyhedron covered by the rolls 15.1, 15.2, 15.3 and 15.4 whose part facing the supply belt conveyor has approximately the same direction as the conveying direction of the supply belt conveyor. One of the rolls 12 or 13 is driven, while the pressure belt 14 is dragged by the reversal belt 11.

The second intermediate belt conveyor for the second deflection or reversal (method step 3) has essentially the same construction as the first intermediate belt conveyor, i.e. it has a deflection or reversal belt 31 with a reversal roll 32 and a delivery roll 33, as well as a pressure belt 34 with its own four rolls 35.1, 35.2, 35.3 and 35.4 whereof one (35.4) serves as a take-up roll and is positioned in the vicinity of the delivery roll 13 of the first intermediate belt conveyor.

Between the delivery roll 13 of the first intermediate belt conveyor and the take-up roll 35.4 of the second intermediate belt conveyor is provided a clock or timing element 21. In this area the scale flow is timed (method step 2), i.e. the printed products are stopped at a stop element 21.1 and raised over the latter in timed manner by a delivery element 21.2. The function and construction of the timer will be described in conjunction with FIGS. 3 and 4. In order that the timing and following takeover of the printed products with respect to the second intermediate belt conveyor can take place in orderly form, the printed products are also raised over this point by a pressure belt 24, which e.g. runs over three rolls 25.1, 25.2 and 25.3 can easily be deflected from its path defined by the three rolls by the moving conveyor element 21.2. The speed of the second intermediate belt conveyor is a function of the spacings of the printed products required for the intended takeover.

The scale flow formed in the second deflection is gripped in the vicinity of the delivery roll 33 of the second intermediate belt conveyor by the grippers 41.1, 41.2, 41.3, etc. of a corresponding conveying means 6 (method step 4). Such arrangements correspond to the cited prior art and will not therefore be described here. It is advantageous to linearly move the grippers over the acceptance point, as shown in the drawing, until each gripped product is definitively released from the scale flow (in the drawing grippers 41.4 and 41.5) and only then are the grippers accelerated about the arc of a reversal roll.

An apparatus as shown in FIG. 2 can e.g. be driven by a common drive 61, it being necessary to correspondingly gear up the drives of the individual belts. If the apparatus is to be adaptable to different applications in such a way that the ratio of the spacings of the printed products in the supply flow to the average spacings in the acceptance flow is to be variable, the transmission means must be correspondingly adjustable.

The apparatus for performing the inventive method shown in FIG. 2 as a variant for a supplied scale flow with upwardly directed leading edges and an acceptance of printed products with also upwardly directed leading edges offers the advantage that it can be produced with a minimum base surface requirement and instead extends heightwise, where normally space is less restricted. The entire apparatus can be housed in an accessible housing, in which the scale flow is supplied at the bottom and the products conveyed away at the top.

Exemplified embodiments of the inventive apparatus for other requirements are:

for a supply flow with downwardly directed leading edges there is no need for the first intermediate belt conveyor, the timer directly following the delivery roll of the supply belt conveyor;

for an acceptance from a scale flow with downwardly directed leading edges the second intermediate belt conveyor is not constructed as a reversal belt conveyor, but as a simple, linear conveyor belt, whose function is to adjust the ratio of the spacings of the printed products on the first intermediate belt conveyor or the supply belt conveyor and the spacings on acceptance, (by corresponding relative speeds) and to convey the printed products to the acceptance point or station in the acceptance configuration set up by the timing element and the intermediate belt conveyor.

Figure 3:
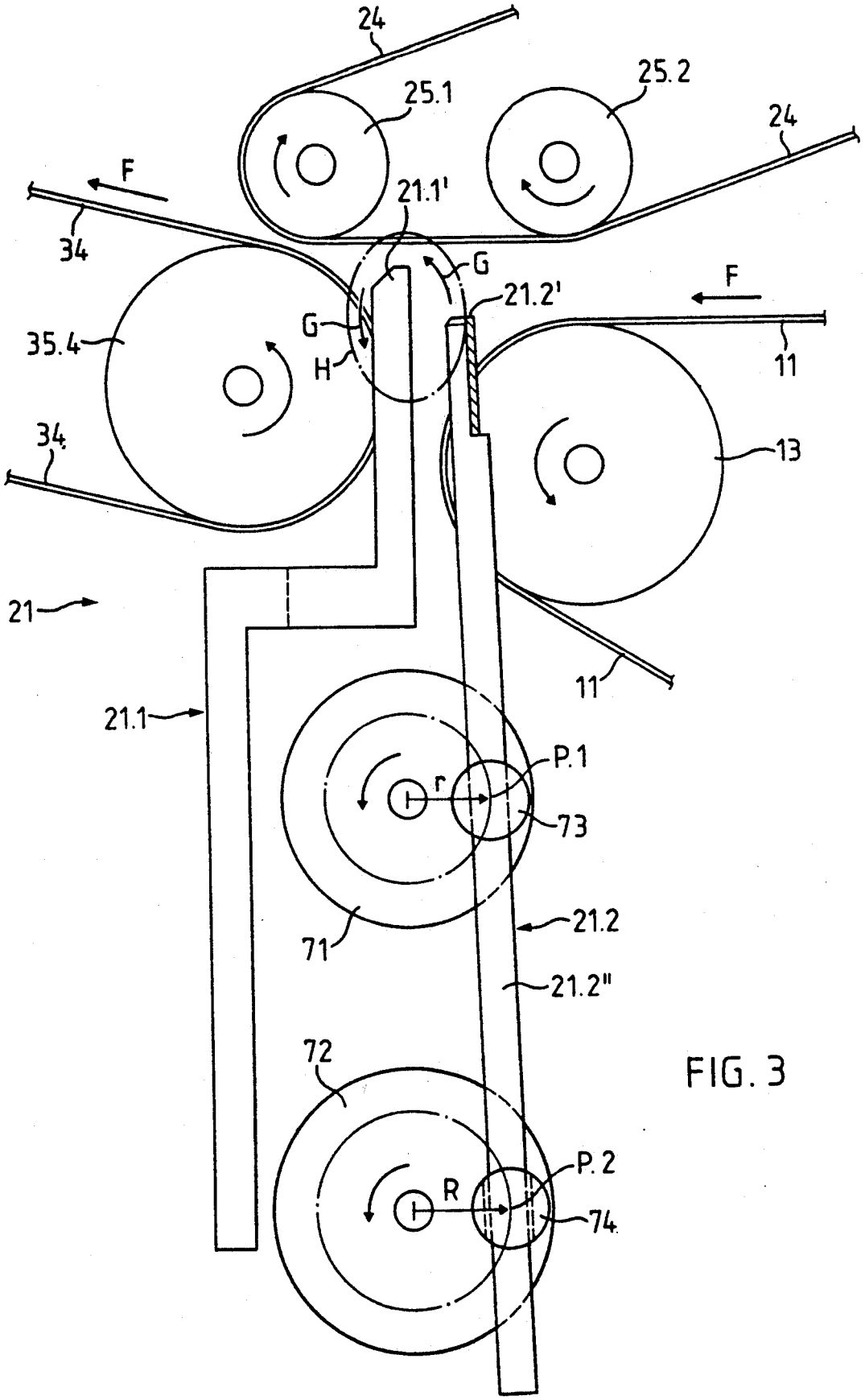
FIG. 3 is an enlarged schematic view of a timing element portion of the apparatus of FIG. 2.

FIG. 3 shows an embodiment of the timer 21 already described in general in connection with FIG. 2. As in FIG. 2 it is possible to see the delivery roll 13 of the first intermediate belt conveyor (it could also be the delivery roll 53 of the supply belt conveyor), the take-up roll 35.4 of the second intermediate belt conveyor, two rolls 25.1 and 25.2 of the pressure belt 24 of the timing system and corresponding portions of the first reversal belt 11, the pressure belt 34 of the second deflection means and the pressure belt 24 of the timing means. The printed product conveying direction is indicated by the arrows F.

The timing element 21 has a fixed stop element 21.1, whose stop end 21.1' is so arranged between the delivery roll 13, the take-up roll 35.4 and the pressure belt 24, that the printed products conveyed on the conveyor belt 11 of the first intermediate belt conveyor are stopped by stop end 21.1'. At right angles to the conveying direction the stop element 21.1 has an extension making it possible to stop the printed products without displacing them at right angles to the conveying direction. In the center of this transverse extension the stop element 21.1 has a gap, at least in the vicinity of its stop end 21.1', through which moves the conveyor element 21.2.

The conveyor element 21.2 is so movably arranged that its conveyor end 21.2' in a vertical plane in the conveying direction can describe an elliptical path H about the line connecting the two halves of the stop end 21.1'. The direction of this movement is such that the conveyor end 21.2' moves upwards when in the conveying direction behind the stop element 21.1, but downwards when upstream of the stop element 21.1 (arrow G). In order that the conveyor end 21.2' can perform such a movement, it must not be wider than said central gap in the stop element 21.1.

The conveyor element 21.2 is e.g. rod-shaped, with a widened conveyor end 21.2' at right angles to the conveying direction and it is driven by a drive wheel 71 and a guide wheel 72. The axes of the two wheels are perpendicular to the conveying direction and substantially parallel to one another and vertically below the stop end 21.1' of the stop element 21.1. The conveyor element 21.2 is fixed to the drive wheel 71 with a rotatable fastening 73 at a rotation point P.1 (fastening point) spaced by r from the axis and is guided on the guide wheel 72 in a guide 74 mounted in rotary manner in a rotation point P.2 (guidance point) spaced by R from the axis. The diameter of the circle (2r) described by the fastening point P.1 is smaller than the diameter of the circle 2r described by the guidance point P.2. If the drive wheel 71 and guide wheel 72 are driven at the same rotational speed, the conveyor end 21.2' describes an ellipse, whose vertical longer diameter corresponds to the diameter 2r.

When the conveyor end 21.2' is in the conveying direction upstream or below the stop end 21.1', printed products conveyed in the vicinity of the timing means are stopped at the stop element. The conveyor end 21.2' approaches such stopped printed products from below and at a very small speed in the conveying direction F. During its further movement it then raises the stopped printed products from the area of the stop end 21.1' against the pressure belt 24 and simultaneously accelerates them. In this way the printed products are raised over the stop end 21.1' and passed into the area between the pressure belt 34 and the pressure belt 24, which are then responsible for conveying them on. Obviously the movement of the printed products is dependent on the ratio of the frequency of the printed products on the belt 11 to the frequency of the elliptical movement of the conveyor end 21.2' and the phase displacement between these two movements and both these parameters can be easily set within a wide range without any mechanical action.

Figure 4:
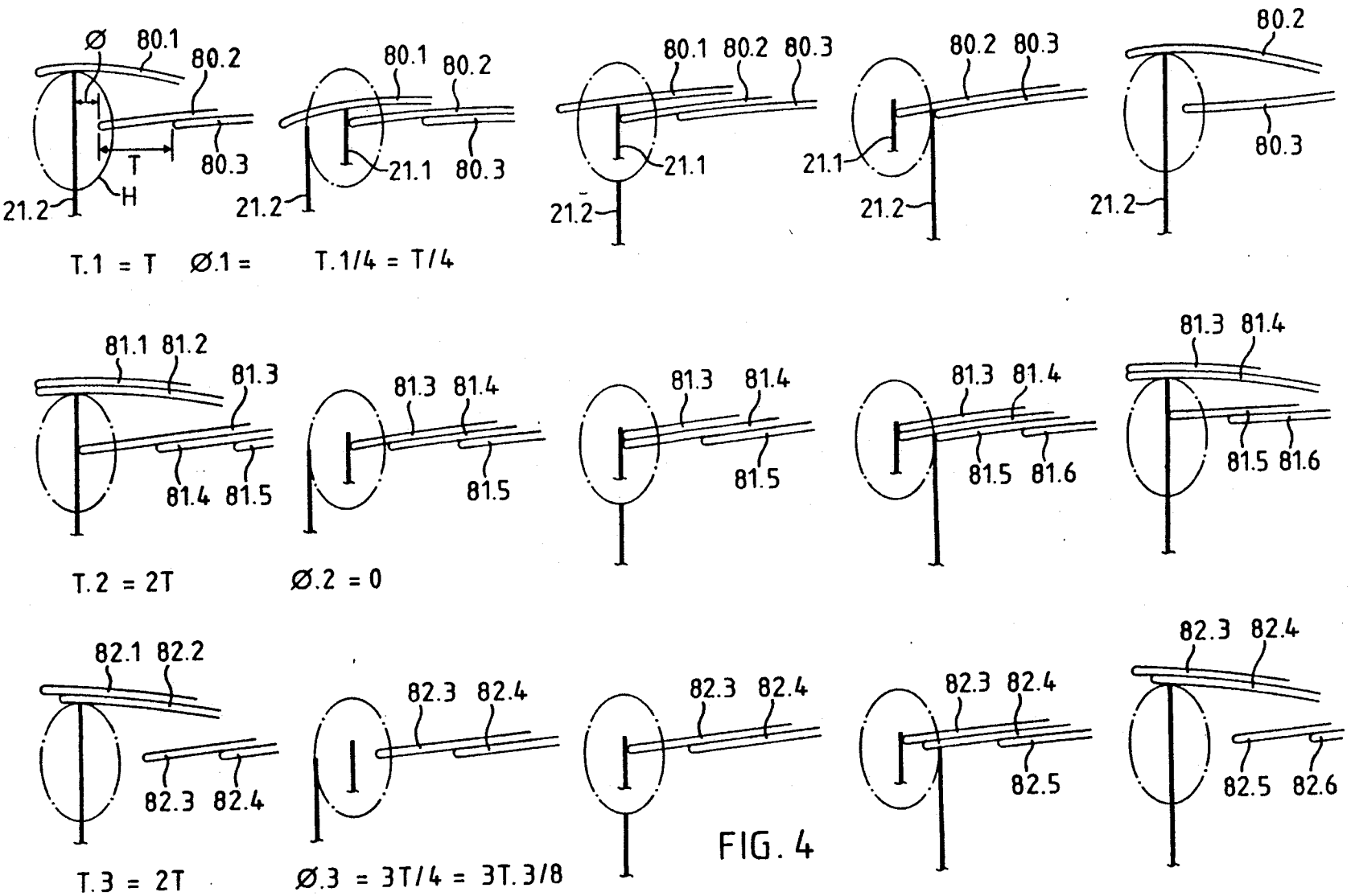
FIG. 4 is a schematic representation of a sequence of positions of the timing element of FIG. 3.

FIG. 4 shows three examples for the function of the timing element, which is diagrammatically represented by the stop element 21.1, the conveyor element 21.2 and the elliptical movement path H of the conveyor end of the conveyor element 21.2 on the one hand and the printed products 80.1, 80.2, 80.3, . . . ; 81.1, 81.2, 81.3, . . . ; and 82.1, 82.2, 82.3, . . . , conveyed in the vicinity of the timing element on the other. The function is determined by the ratio of the revolution time of the conveyor element T.1, T.2 and T.3 to the timing time T of the scale flow (time required in order to convey a printed product to the position of its preceding element) and by the phase displacement 0.1, 0.2 and 0.3 of the two movements, i.e. for example by the time by which the next leading edge is removed from the stop element when the conveyor element is in its highest position.

The top line shows the process of making the spacing uniform in a supplied scale flow, the second line the formation of groups of two with superimposed leading edges and the third line the formation of groups of two with differentiated spacings. The columns represent the timing element in the particular position assumed. In the first column the conveyor element 21.2 is in its highest position, whereas in the following columns, after it has covered 90° of its movement in each case, so that in the column to the far right it has the same position as in the first column. Thus, between the first and last columns the conveyor end 21.2' has performed an elliptical movement.

To render uniform the spacings of the printed products, the stop element and the conveyor element must interact with each printed product, i.e. each individual printed product must be stopped at the stop element and conveyed over the latter by the conveyor element (T.1=T). The correcting action for irregularities is limited to a phase displacement of 0.1=T/4 (as shown) in the event of delays of printed products, i.e. a printed product conveyed delayed by up to half a cycle, is corrected by the arrangement according to the first line of FIG. 4, whereas a printed product conveyed before its clock time passes one cycle too early with the preceding product and with too small a spacing through the timing system. The correction action can be modified by changing the phase displacement. For example, with a phase displacement of 0.1'=T/2 spacings too large or too small by up to T/4 can be corrected.

The second line of FIG. 4 shows the formation of groups of two with superimposed leading edges and for this purpose T.2=2T and 0.2=0. The third line represents the formation of a differentiated scale flow, in which the spacings between the printed products after timing are T/2, 3T/2, T/2, 3T/2 etc. The conditions for the operations are T.3=2T and 0.3=3T/4. Irregularities in the scale flow are compensated to a limited extent during the formation of groups of two. The effective spacings of the printed products after the timing system are also dependent on the ratio of the belt sleeves before and after the timing element.

The functions of the timing element shown in FIG. 4 can be extended almost at random by varying the ratio T/T.x and the phase displacement 0.x. Further variants are also possible by different ratios between the horizontal diameter of the ellipse H and the printed product spacing upstream of the timing element. Further possibilities for varying the obtainable formations can be achieved in that two or more inventive timing elements are connected in series, it always being necessary to provide a further conveyor belt between each two timing elements.

I claim:

1. A method of product flow transformation of a delivery flow of printed products in a formation in which the relative positions of the products are not fixed into an acceptance flow of products in which the relative positions of the products are fixed comprising the steps of conveying the delivery flow of products on a first conveyor to a timing location with leading edges of the products positioned downwardly, at the timing location, engaging the products adjacent their leading edges and transferring the products of the delivery flow to a second conveyor while selectively accelerating or retarding the progress of the products in accordance with a predetermined rhythmic pattern to arrange the products in an acceptance flow of uniformly spaced units of one or more products per unit, conveying the acceptance flow of units of products to an acceptance location, and gripping each unit with fixedly spaced grippers and removing the units of products from the second conveyor.

2. A method according to claim 1 wherein the delivery and acceptance flows are scale flows, the delivery scale flow having a scale spacing statistically deviating from a desired spacing, and wherein the step of engaging and accelerating or retarding includes reducing the magnitude of the statistical deviation.

3. A method according to claim 1 wherein the delivery and acceptance flows are scale flows, the first scale flow having a scale spacing statistically deviating from a desired spacing, and wherein the step of engaging and accelerating or retarding includes cyclically alternating product spacings.

4. A method according to claim 1 and including a preliminary step of receiving a scale flow of products in which the leading edge of each product is upwardly oriented and converting the scale flow into a delivery flow in which the leading edge of each product is downwardly oriented.

5. A method according to claim 1 wherein in the step of engaging and accelerating or retarding includes positioning the products so that the products are uniformly spaced with a spacing greater than the average spacing of products in the delivery flow.

6. A method according to claim 1 wherein in the step of engaging and accelerating or retarding includes positioning the products so that the products are uniformly spaced with a spacing smaller than the average spacing of products in the delivery flow.

7. A method according to claim 1 wherein in the step of engaging and accelerating or retarding includes positioning the products so that the products are uniformly spaced with a spacing substantially equal to the average spacing of products in the delivery flow.

8. A method according to claim 1 wherein in the step of engaging and accelerating or retarding includes positioning the products so that the product spacing is differentiated.

9. A method according to claim 8 wherein the differentiation includes grouping printed products into units of a plurality of products with the leading edges of the products of each group aligned vertically.

10. A method according to claim 1 wherein the step of engaging and accelerating or retarding includes adjusting the timing (T.1, T,2, T.3) of a means for engaging and accelerating and retarding relative to the conveyor delivering the delivery flow.

11. An apparatus for transforming a delivery flow of printed products in a formation in which the relative positions of the products are not fixed into an acceptance flow of products in which the relative positions of the products are fixed comprising the combination of first conveying means for supplying said delivery flow to a timing location;

second conveying means for carrying products away from said timing location, said second conveying means having an inlet end adjacent said timing location and an outlet end;

timing means at said timing location for engaging leading edges of said products, for transferring said products from said first conveying means to said second conveying means, and for selectively accelerating or retarding said products during transfer, said timing means including a stationary stop element and a conveyor element acting alternately on said products, said conveyor element being rhythmically movable relative to said stop element to move said leading edges of said products and transfer said products past said stop element to said second conveying means; and gripping means adjacent said outlet end for gripping said products and conveying said products away from said second conveying means.

12. An apparatus according to claim 11 wherein said second conveying means includes a reversing conveyor having a delivery roll, a reversal roll and a reversal conveyor belt passing around said delivery and reversal rolls;

at least three pressure belt guide rolls; and a pressure belt passing around said three pressure belt guide rolls and said reversal roll with said printed products between said reversal conveyor belt and said pressure belt.

13. An apparatus according to claim 11 wherein said stop element includes a stop face extending transversely to the conveying direction and having a central gap, and wherein said conveyor element moves through said gap.

14. An apparatus according to claim 13 wherein said first conveying means includes a second reversing conveyor upstream of said timing location in product flow direction.

15. An apparatus according to claim 13 wherein said conveyor element having a support portion dimensioned to pass through said gap and a transversely widened portion for engaging said printed products, said timing means further comprising a drive wheel, means for rotatably attaching said support portion to said drive wheel; and a guide wheel having a guide rim for engaging and guiding said support portion.

16. An apparatus according to claim 15 and further comprising means for rotatably supporting axes of rotation of said guide wheel and said drive wheel in substantial vertical alignment and vertically below a stop face of said stop element.

17. An apparatus according to claim 16 wherein a distance r between said axis of rotation of said drive wheel and a point of rotatable attachment of said support portion to said drive wheel is smaller than a distance R between said axis of rotation of said guide wheel and said guide rim.

18. An apparatus according to claim 11 wherein said timing location includes a second timing means and a third conveying means between said first-mentioned timing means and said second timing means.

* * * * *